US006250285B1

(12) United States Patent
Takase

(10) Patent No.: US 6,250,285 B1
(45) Date of Patent: Jun. 26, 2001

(54) COMMON-RAIL, FUEL-INJECTION SYSTEM

(75) Inventor: Shigehisa Takase, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/340,162

(22) Filed: Jun. 28, 1999

(30) Foreign Application Priority Data

Jul. 1, 1998 (JP) ..... 10-186639

(51) Int. Cl.[7] ..... F02M 41/00; F02M 51/00
(52) U.S. Cl. ..... 123/456; 123/480
(58) Field of Search ..... 123/456, 446, 123/447, 497, 499, 480

(56) References Cited

U.S. PATENT DOCUMENTS 4,462,368 * 7/1984 Funada ..... 123/446
4,759,330 * 7/1988 Kato et al. ..... 123/446
5,697,343 * 12/1997 Isozumi et al. ..... 123/446

FOREIGN PATENT DOCUMENTS 62-186034 8/1987 (JP) .
10-077924 3/1998 (JP) .

* cited by examiner

*Primary Examiner*—Henry C. Yuen
*Assistant Examiner*—Mahmoud M Gimie
(74) *Attorney, Agent, or Firm*—Browdy & Neimark

(57) ABSTRACT

Disclosed a common-rail, fuel-injection system in which an actual quantity of fuel injected is found in consideration for a quantity of dynamic fuel leakage, thereby making it possible to inject a desired quantity of fuel per cycle in accordance with the engine operating conditions. A quantity of fuel to be supplied from the common rail is found from a first mapped data defined previously, in conformity with a common-rail pressure Pch and a difference ΔPc in pressure taking place between the common-rail pressures just before and after the fuel injection. Moreover, a quantity of dynamic fuel leakage is found from a second mapped data defined previously, in conformity with a common-rail pressure Pch just before the fuel injection and a command-pulse width for controlling the fuel injection. The actual quantity of fuel injected is found by subtracting the quantity of dynamic fuel leakage from the quantity of fuel supplied and the fuel injection is controlled so as to correct the consequent actual quantity of fuel injected to a desired quantity of fuel injected.

9 Claims, 10 Drawing Sheets

COMMON-RAIL, FUEL-INJECTION SYSTEM

BACKGROUND OF THE INVENTION

1. Field of the Invention

The present invention relates to a common-rail, fuel-injection system in which fuel under high-pressure in a common rail is injected into the combustion chambers of engines.

2. Description of the Prior Art

Among various types of fuel-injection systems for engines is conventionally well-known a common-rail, fuel-injection system in which the fuel stored under high-pressure in the common rail is applied to the injectors, which are in turn actuated by making use of a part of the high-pressure fuel as a working fluid to thereby spray the fuel applied from the common rail into the combustion chambers out of discharge orifices formed at the tips of the injectors.

An example of a conventional common-rail, fuel-injection system will be explained below with reference to FIG. 9. A fuel feed pump 6 draws fuel from a fuel tank 4 through a fuel filter 5 and forces it under a preselected intake pressure to a high-pressure, fuel-supply pump 8 through a fuel line 7. The high-pressure, fuel-supply pump 8 is of, for example, a fuel-supply plunger pump driven by the engine, which intensifies the fuel to a high pressure determined depending on the engine operating conditions, and supplies the pressurized fuel into the common rail 2 through another fuel line 9. The fuel, thus supplied, is stored in the common rail 2 at the preselected high pressure and forced to the injectors 1 through injection lines 3 from the common rail 2. The engine illustrated is a six-cylinder engine. There are six injectors 1, each to each cylinder, to spray the fuel into the combustion chambers formed in the cylinders. The engine is not limited to the six-cylinder type, but may be the four-cylinder engine.

The fuel relieved from the high-pressure, fuel-supply pump 8 is allowed to flow back the fuel tank 4 through a fuel-return line 10. The unconsumed fuel remaining in each injector 1 out of the fuel fed through the fuel line 9 into the injectors 1 may return to the fuel tank 4 through a fuel-recovery line 11. The controller unit 12 is applied with various signals of sensors monitoring the engine operating conditions, such as a crankshaft position sensor for detecting the engine rpm Ne, an accelerator pedal sensor for detecting the depression Ac of an accelerator pedal, a high-pressure fuel temperature sensor and the like. In addition, the sensors for monitoring the engine operating conditions include an engine coolant temperature sensor, an intake manifold pressure sensor and the like. The controller unit 12 is also applied with a detected signal as to a fuel pressure in a common-rail 2, which is reported from a pressure sensor 13 installed in the common rail 2.

The controller unit 12 may regulate the fuel injection characteristics on the injectors 1, including the injection timing and the quantity of fuel injected, depending on the applied signals, so as to operate the engine with the optimal injection timing and quantity of fuel injected per cycle in conformity with the recent engine operating conditions, thereby allowing the engine to operate as fuel-efficient as possible. As the injection pressure of the fuel sprayed out of the injectors is substantially equal with the common rail pressure, the injection pressure defining, in combination with the injection duration, the quantity of fuel injected per cycle may be controlled by operating a fuel flow-rate control valve 14, which is to regulate the quantity of high-pressure fuel supplied to the common rail 2. In case the injection of fuel out of the injectors 1 consumes the fuel in the common rail 2 or it is required to alter the quantity of fuel injected, the controller unit 12 actuates the fuel flow-rate control valve 14, which in turn regulates the quantity of delivery of the fuel from the high-pressure, fuel-supply pump 8 to the common rail 2 whereby the common rail pressure recovers the preselected fuel pressure. Regulating a duration during which the fuel flow-rate control valve 14 is open results in controlling the quantity of the fuel fed into the common rail 2 through the fuel line 9 out of the fuel discharged from the high-pressure, fuel-supply pump 8.

Referring to FIG. 10, the injector 1 is comprised of an injector body 21, and an injection nozzle 22 mounted to the injector body 21 and formed therein with an axial bore 23 in which a needle vale 24 is fitted for a sliding movement. The high-pressure fuel applied to the individual injector 1 from the common rail 2 through the associated injection line 3 is allowed to flow into fuel passages 31, 32 formed in the injector body 21 and communicated with the associated injection line 3 through a high-pressure fuel inlet coupling 30. The high-pressure fuel further reaches the discharge orifices 25, formed at the tip of the injection nozzle 22, past a fuel sac 33 formed in the injection nozzle 22 and a clearance around the needle valve 24 fitted in the axial bore 23. Therefore, the instant the needle valve 24 is lifted to open the discharge orifices 25, the fuel is injected out of the discharge orifices 25 into the combustion chamber while the unconsumed fuel remaining in the injector 1 may return to the common rail 2 through a fuel-recovery line 11.

The injector 1 is provided with a needle-valve lift mechanism of pressure-control chamber type in order to adjust the lift of the needle valve 24. The high-pressure fuel fed from the common rail 2 is partly admitted into a pressure-control chamber 40. The injector 1 has at the head section thereof a solenoid-operated valve 15, which constitutes an electronically-operated actuator to control the inflow/outflow of the high-pressure fuel with respect to the pressure-control chamber 40. The controller unit 12 makes the solenoid-operated valve 15 energize in compliance with the engine operating conditions, thereby adjusting the fuel pressure in the pressure-control chamber 40 to either the high pressure of the admitted high-pressure fuel or a low pressure released partially in the pressure-control chamber 40. On energizing a solenoid 38 in the solenoid-operated valve 15 by an exciting signal, for example, a current value, which is a control signal applied from the controller unit 12 via a signaling line 37, the armature 39 rises to open a valve 42 arranged at one end of a fuel-leakage path 41. The fuel fed in the pressure-control chamber 40 is allowed to discharge past the opened valve 42 to thereby release partially the high fuel pressure.

A control piston 44 is arranged for axial linear movement in an axial recess 43 formed in the injector body 21 of the injector 1. At the event the pressure-control chamber 40 is under the high pressure, the fuel pressure forces the needle valve 24 downward to close the discharge orifices 25. When the solenoid-operated valve 15 is energized to cause the fuel pressure inside the pressure-control chamber 40 to reduce, the resultant force of the fuel pressure in the pressure-control chamber 40 with the spring force of the return spring 45, acting on the control piston 44 so as to pushing it downward, is made less than the fuel pressure acting on both a tapered surface exposed to a fuel sac 33 and the distal end of the needle valve 24, whereby the control valve 44 moves upwards. As a result, the needle valve 24 lifts to allow the fuel to spray out of the discharge orifices 25. The quantity of fuel injected per cycle is defined dependent on the fuel pressure in the fuel passages and both the amount and duration of lift of the needle valve 24.

The actual quantity of fuel injected is calculated based on an amount of pressure drop occurring nearby the fuel injection. The controller unit 12 adjusts a duration during which the fuel-injection nozzle is held open, so as to make the found actual quantity of fuel injected a desired quantity of fuel to be injected conforming with the engine operating conditions. Calculating the actual quantity of fuel injected is disclosed in Japanese Patent Laid-Open No. 186034/1987. According to a fuel-injection control described in the above citation, the pressure-control chamber is of a control-rod pressure chamber of a volumetric component, so that pressurizing or depressurizing owing to variations in volume causes the needle valve to move upward and downward thereby injecting the fuel out of the discharge orifices at the end of the fuel-injection valve. As an alternative, the actual quantity of fuel injected may be calculated in accordance with the amount of pressure drop in the common rail, the common rail pressure just before the pressure fall and the fuel temperature. Control of the open and the closure of the fuel-injection valve is carried out by multiplying the desired quantity of the injected fuel by the ratio of the desired quantity of the injected fuel to the actual quantity of fuel injected, thereby finding a corrected, desired quantity of fuel injected.

On the other hand, disclosed in co-pending senior patent application in Japan, or Japanese Patent Laid-Open No. 77924/1998 is a fuel-injection apparatus in which a valve having a tapered valve head in a pressure-control chamber makes the supply and relief of the high pressure in the pressure-control chamber. The fuel-injection apparatus cited above includes a valve stem extending into a pressure-control chamber past a discharge passage for relieving the fuel pressure from the pressure-control chamber. The valve stem is provided at its end with the tapered valve head having a valve face, which moves away from and reseats against a valve seat at the ingress end of the discharge passage to thereby control the fuel pressure in the pressure-control chamber as well as the relief of the fuel pressure. The instant the valve is made open to allow the high-pressure fuel to leak out the pressure-control chamber, the needle valve starts to lift thereby injecting the fuel out of the discharge orifices at the distal end of the injector. In our senior concept as cited briefly above, as the actuator has no pressure affecting the fuel in the pressure-control chamber, there is no need of paying attention to the sealing performance in the pressure-control chamber. This is advantageous to dealing with the requirements as to the high fuel-injection pressure used in the modern diesel engines.

Nevertheless, in the common-rail, fuel-injection system as described above, the actual quantity of fuel injected out of the discharge orifices at the distal end of the injector is a part of the fuel fed to the injector, whereas another part of the fuel in the injector becomes a dynamic leakage flowing out from the pressure-control chamber to the relatively low-pressure side past the valve. It is, therefore, substantially impossible to find the actual quantity of fuel injected per cycle, based on only the pressure fall in the common rail pressure. This makes it very hard to control the operation of the injector so as to provide the desired quantity of fuel injected, causing a major problem of failure to achieve the optimal fuel-injection control, which results in making the exhaust gases performance and noise control worse.

In the common-rail, fuel-injection system, accordingly, in order to calculate by the controller unit the desired quantity of fuel to be injected in compliance with the detected engine operating conditions, it is necessary to find how part of the fuel entering the injector from the common rail is the actual quantity of fuel injected really out of the injector, and control the fuel injection so as to make the desired quantity of fuel injected of the actual quantity of fuel injected.

SUMMARY OF THE INVENTION

A primary object of the present invention is to provide a common-rail, fuel-injection system in which a fuel discharged out of a high-pressure fuel pump is stored in a common rail, the fuel fed from the common rail is sprayed out of injectors into combustion chambers, and controller unit regulates the fuel injection out of the injectors in accordance with a desired quantity of fuel to be injected, which is found dependent on signals reported from means for monitoring engine operating conditions, the improvement constructed so as to find how part of the fuel entering the injector from the common rail is the actual quantity of fuel injected really out of the injector, and control the fuel injection so as to make the desired quantity of fuel injected of the actual quantity of fuel injected, whereby the optimal fuel-injection control may be achieved, resulting in preventing the exhaust gases performance and noise control from becoming worse.

This makes it very hard to control the operation of the injector so as to provide the desired quantity of fuel injected, causing a major problem of failure to achieve the optimal fuel injection, which results in making the exhaust gases performance and noise control worse.

The present invention is concerned with a common-rail, fuel-injection system comprising, a common rail storing therein a fuel discharged out of a high-pressure fuel pump, injectors for spraying the fuel fed from the common rail into combustion chambers, detecting means for monitoring engine operating conditions, and a controller unit for finding a desired quantity of fuel to be injected out of the injectors dependent on signals from the detecting means and controlling fuel injection out of the injectors in accordance with the desired quantity of fuel injected, wherein the controller unit finds a quantity of dynamic fuel leakage out of the injectors upon the fuel injection, and subtracts the quantity of dynamic fuel leakage from the quantity of fuel supplied to the injectors from the common rail to find an actual quantity of fuel injected, whereby the fuel injection out of the injectors is controlled so as to make the desired quantity of fuel injected of the actual quantity of fuel injected.

According to the present invention, as the actual quantity of fuel really injected out of the injectors is found by subtracting the quantity of dynamic fuel leakage from the quantity of fuel supplied to the injectors from the common rail, for example, even if the actual quantity of fuel injected is less compared with the desired quantity of fuel to be injected, the controller unit increase the desired quantity of fuel injected thereby compensating the quantity of dynamic fuel leakage whereby the injectors is operated so as to make the desired quantity of fuel injected of the actual quantity of fuel injected.

In one aspect of the present invention a common-rail, fuel-injection system is disclosed, wherein the detecting means includes a pressure sensor for monitoring a fuel pressure in the common rail, and the controller unit stores therein a first mapped data of a correlation defined previously among the fuel pressure in the common rail just before the fuel injection, an amount of pressure drop taking place on the fuel pressure in the common rail between just before and after the fuel injection and the quantity of fuel supplied, and finds the quantity of fuel supplied upon the fuel injection, based on the first mapped data, in conformity with the fuel pressure in the common rail detected by the pressure sensor at a timing just before the fuel injection and the amount of pressure drop caused by the fuel injection. That is to say, it may be presumed that the injector might be supplied more quantity of fuel from the common rail, as the fuel pressure in the common rail becomes higher so long as the fuel-injection duration in the injector is unchanged, or as the pressure drop in the common rail increases as long as the fuel pressure in the common rail just before the fuel injection is unchanged. The correlation as described just above is stored previously in the form of the first mapped data. Hence, the quantity of fuel supplied to the injector may be obtained by making use of the first mapped data in accordance with the data as to the fuel pressure in the common rail.

In another aspect of the present invention a common-rail, fuel-injection system is disclosed, wherein the injector includes a pressure-control chamber applied with a part of the fuel fed from the common rail, a needle valve movable upward and downward, depending on a hydraulic action of the fuel in the pressure-control chamber, to thereby open and close fuel-discharge orifices at a distal end of the injector, a valve for allowing the fuel to discharge out of the pressure-control chamber thereby resulting in relieving the fuel pressure in the pressure-control chamber, and an actuator for driving the valve, and wherein the quantity of dynamic fuel leakage is recognized as a quantity of fuel leaking out of the pressure-control chamber past the valve.

In another aspect of the present invention a common-rail, fuel-injection system is disclosed, wherein the controller unit outputs a command pulse controlling an exciting pulse that is applied to the actuator to open the valve, stores therein a second mapped data of a correlation defined previously among the fuel pressure in the common rail just before the fuel injection, the amount of dynamic fuel leakage and a pulse width of the command pulse, and finds the quantity of dynamic fuel leakage upon the fuel injection, based on the second mapped data, in accordance with the command pulse width that is found dependent on the fuel pressure in the common rail detected by the pressure sensor at the timing just before the fuel injection and the amount of pressure drop caused by the fuel injection. That is, the command pulse width defines the duration during which the actuator is kept energized and, therefore, the longer is the duration the actuator is energized, the longer the duration the actuator-operated valve is kept open is to thereby increase the quantity of dynamic fuel leakage. It is further presumed that the pressure in the pressure increases with the fuel pressure in the common rail just before the fuel injection increasing, thereby resulting in the increase of the quantity of fuel, which leaks out of the pressure-control chamber past the valve. The correlation as described just above is stored previously in the form of the second mapped data. As a result, the quantity of dynamic fuel leakage may be obtained by making use of the second mapped data in accordance with the command pulse width and the data as to the fuel pressure in the common rail.

In another aspect of the present invention a common-rail, fuel-injection system is disclosed, wherein the controller unit finds the actual quantity of fuel injected for every cylinder, and controls the fuel injection out of the injector for the individual cylinder, depending on the associated actual quantity of fuel injected. Scattering arises usually in the quantity of dynamic fuel leakage and, therefore, it is preferable to find the actual quantity of fuel injected for the individual cylinder to thereby control the fuel injection.

In a further another aspect of the present invention a common-rail, fuel-injection system is disclosed, wherein the controller unit finds a correction coefficient represented by a ratio of the desired quantity of fuel supplied with respect to the actual quantity of fuel injected, finds a corrected, desired quantity of fuel injected by multiplying the correction coefficient by the desired quantity of fuel to be injected at next fuel injection of the same injector whereby the next fuel injection out of the same injector is controlled, dependent on the corrected, desired quantity of fuel injected. In general, since the actual quantity of fuel injected really is less in value than the desired quantity of fuel injected, the correction coefficient is given as a value over 1 and, therefore, multiplying the correction coefficient by the desired quantity of fuel injected results in the corrected, desired quantity of fuel injected of the value larger than the desired quantity of fuel injected. Hence, by intensifying the fuel pressure in the common rail or extending the command pulse width, the fuel injection may be adjusted so as to increase the actual quantity of fuel injected.

In another aspect of the present invention a common-rail, fuel-injection system is disclosed, wherein the high-pressure fuel pump is of a fuel-supply plunger pump for discharge the fuel to the common rail to spray the fuel out of the injector for the individual cylinder, the controller unit carries out, during each plunger in the high-pressure fuel pump travels from its bottom dead center to its top dead center, the fuel injection out of the injector at the cylinder associated with the plunger and the fuel discharge out of the high-pressure fuel pump into the common rail.

In another aspect of the present invention a common-rail, fuel-injection system is disclosed, wherein the high-pressure fuel pump is provided at a discharge end thereof with a flow-rate control valve, the controller unit regulates the flow-rate control valve so as to make a timing, at which a full-power discharge duration ceases, coincide with an end of a discharge duration during which the high-pressure fuel pump discharges the fuel for providing the next fuel injection at any cylinder in accordance with the firing order.

In a further aspect of the present invention, a common-rail, fuel-injection system is disclosed, wherein the controller unit makes the fuel pressure in the common rail after the delivery of the fuel by the high-pressure fuel pump for the fuel injection while before the start of the exciting signal to the injector for the fuel injection the fuel pressure in the common rail just before the fuel injection, and further makes the fuel pressure in the common rail detected after the end of the fuel injection while before the start of the discharge duration of the fuel by the high-pressure fuel pump for the next fuel injection the fuel pressure in the common rail after the fuel injection.

In accordance with the present invention, the actual quantity of fuel injected, which varies for the individual injector, is found in consideration for a quantity of dynamic fuel leakage of the injector, and the desired quantity of fuel injected is adjusted dependent on the difference between the desired quantity and the actual quantity of fuel injected so as to make the desired quantity of fuel injected of the actual quantity of fuel injected. This results in improving the variations in engine rpm, vibrations, noises and exhaust gas emissions, which are caused by scattering in fuel-injection characteristics for the individual injector. Attention to the quantity of dynamic fuel leakage makes it possible to find concurrently the actual quantity varying owing to aging in the same injector and corrects the desired quantity of fuel injected whereby the exhaust gas emissions are protected from turning for the worse. Scattering in the quantity of fuel injected for every injection cycle or every several injection cycles among the injectors is detected by the same manner as described above to adjust the command pulse width controlling the exciting signal applied to the injectors. This also results in improving the variations in engine rpm, vibrations, noises and exhaust gas emissions.

Other objects and features of the present binvention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DESCRIPTION OF THE PREFERRED EMBODIMENTS

Figure 9:
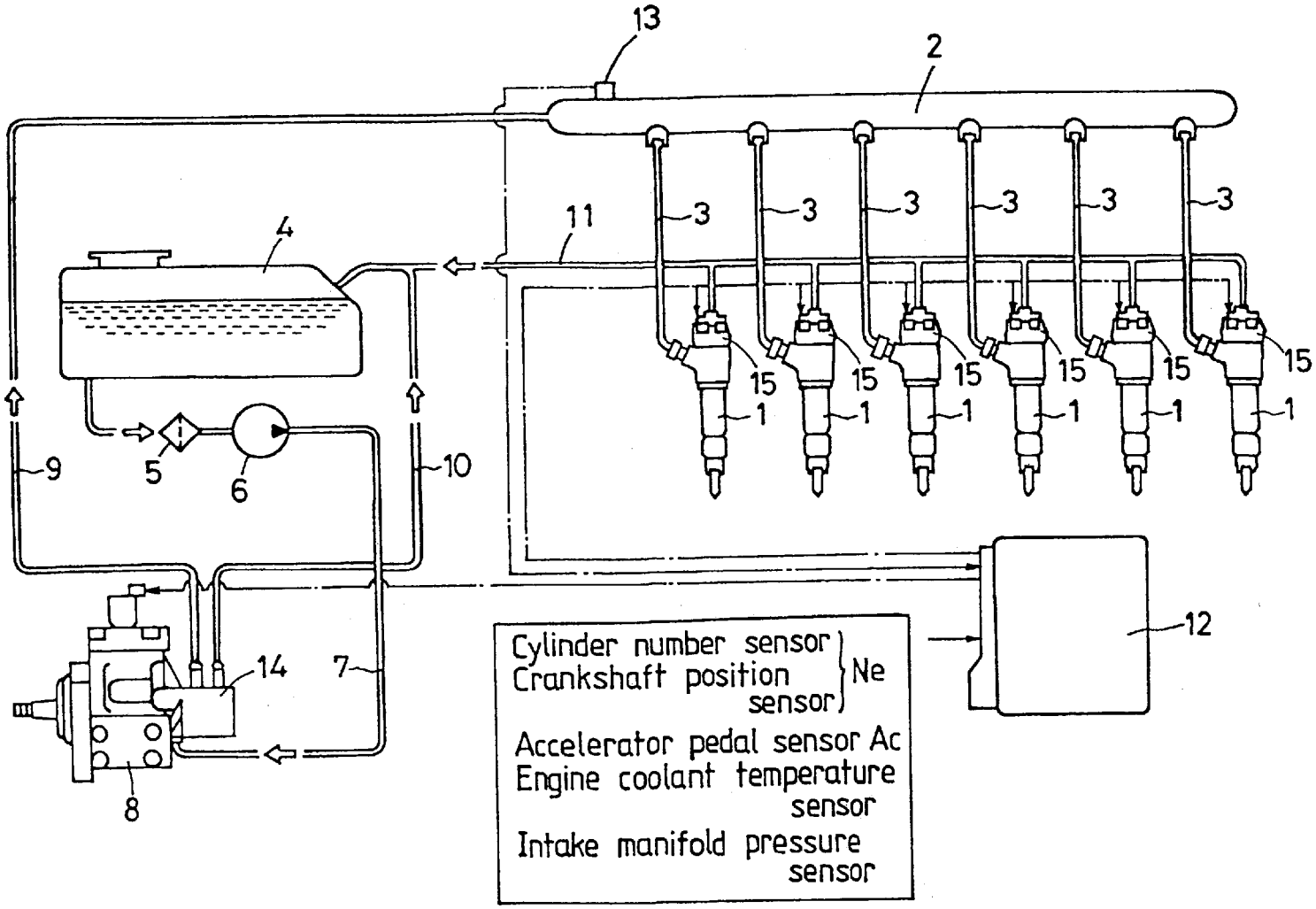
FIG. 9 is a schematic illustration of an arrangement of a conventional common-rail, fuel-injection system.
Figure 10:
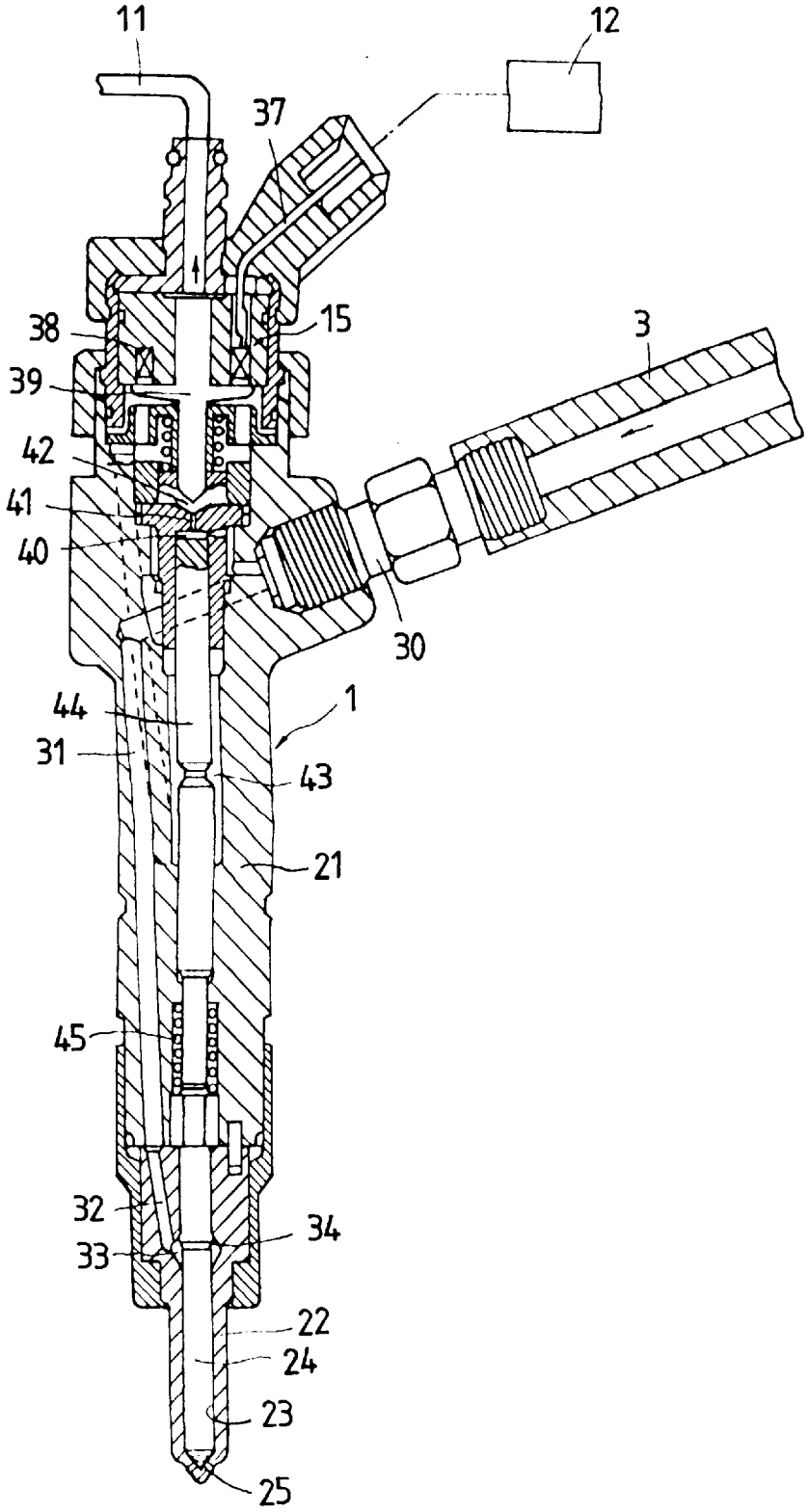
FIG. 10 is an axial section showing an example of an injector incorporated in the common-rail, fuel-injection system in FIG. 9.

A preferred embodiment of a fuel-injection system according to the present invention will be explained in detail hereinafter with reference to the accompanying drawings. The common-rail, fuel-injection system and injectors in FIGS. 9 and 10 are applicable to that according to the present invention. Most of components of the system, thus, are the same as previously described. To that extent, the components have been given the same reference characters as shown in FIGS. 9 and 10, so that the previous description will be applicable.

Figure 1:
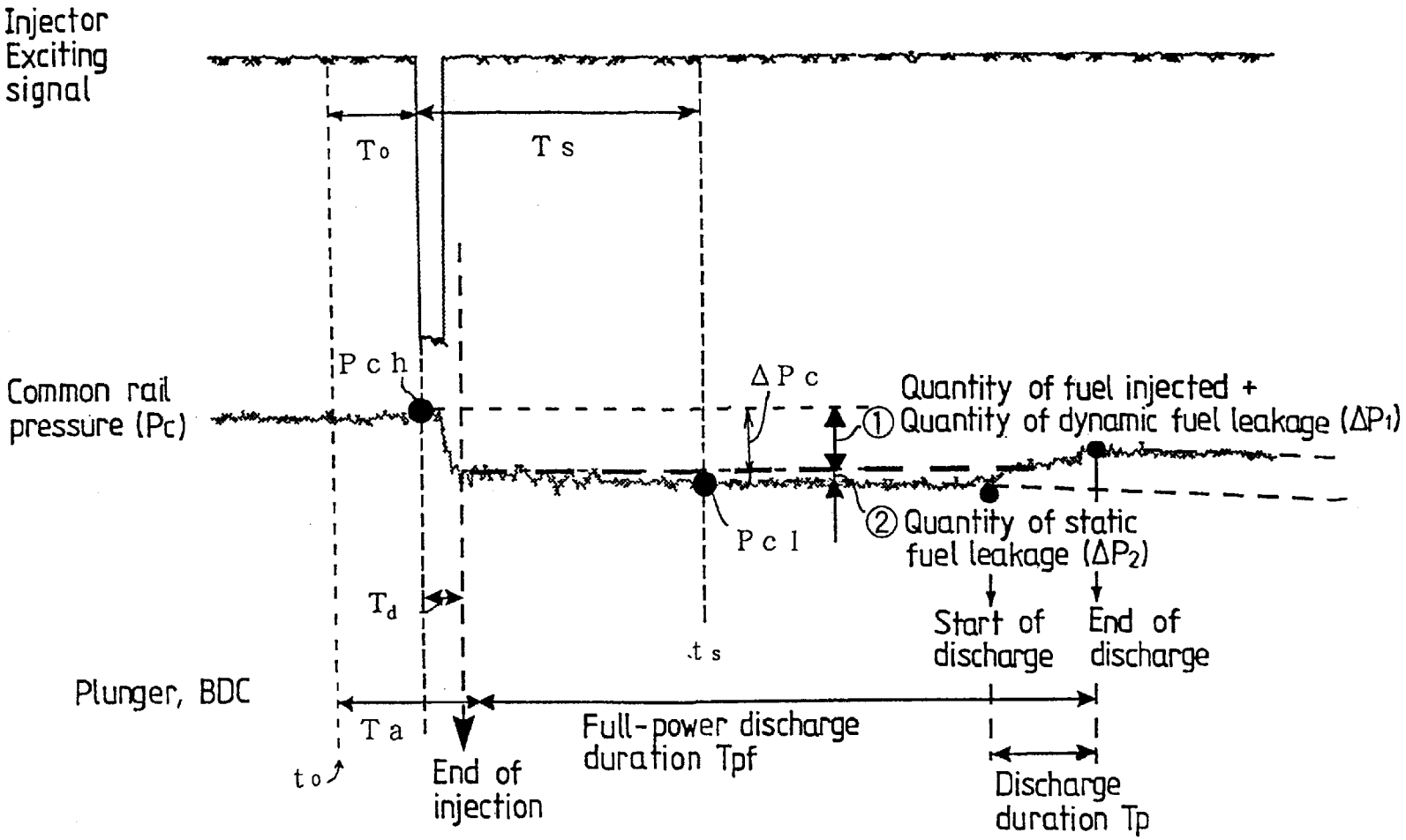
FIG. 1 is a composite graph of an exciting signal for injectors and a common rail pressure versus time in a common rail, fuel-injection system according to the present invention.

First referring to FIG. 1, a plunger in the high-pressure fuel pump 8 reaches the bottom dead center thereof, abbreviated to BDC hereinafter, at a time $t_0$. Just after a lapse of a length of time $T_0$ beginning at time $t_0$, the injector 1 is applied with an exciting signal that falls, thereby initiating the operation for fuel injection. Immediately after a lapse of a length of time Td, which involves a time lag following a timing at which the exciting signal rises, beginning with the start of the fuel injection, the fuel injection ceases. On the other hand, the common rail pressure Pc begins pressure drop with a time lag after the start of the fuel injection, in correspondence to the fuel injection for every cylinder in the engine operating cycle. After the end of the injection, the common rail pressure Pc recovers dependent on the fuel discharged out of the high-pressure pump 8 for providing the fuel injection at any cylinder, in which the next combustion is to be carried out in accordance with the firing order of the engine. This sequence repeats as to the common rail pressure Pc. That is to say, during such a phase that the plunger in the high-pressure fuel pump 8 travels from the bottom dead center to the top dead center, any cylinder is subjected to the fuel injection and the pressure recovery in the common rail, which is ensured by the delivery of fuel after the last fuel injection.

A difference ΔPc in the common rail pressure, namely, an amplitude of pressure drop taking place on the fuel pressure in the common rail between just before the start and after the end of the fuel injection, is recognized as a difference between a higher pressure Pch detected at a pressure sensor 13 just before the fuel injection and a reduced pressure Pc1 detected by the same sensor 13 at a timing ts, which is after a lapse of a length of time Ts from the time $t_0$, in other words, ΔPc=Pch−Pc1. The difference ΔPc in the common rail pressure is also recognized as the sum of an amount of pressure drop $\Delta P_1$ and an amount of pressure drop $\Delta P_2$, namely, $\Delta Pc=\Delta P_1+\Delta P_2$. The amount of pressure drop $\Delta P_1$ occurs in proportion to the sum of an actual quantity of fuel injected really out of the discharge orifices 25 into the combustion chambers and a quantity of dynamic fuel leakage out the pressure-control chamber 40, while the amount of pressure drop $\Delta P_2$ appears in correspondence to a quantity of static fuel leakage out of the injector, which might exist in case where the fuel leaks out of the injector despite no fuel injection is carried out. In case where there is the static leakage of fuel, it causes the common rail pressure Pc to fall gradually still even after the fuel injection has ceased. Most static leakage of fuel may be sufficiently small to be considered negligible and therefore, in this case, the difference ΔPc in the common rail pressure taking place between just before the start and after the end of the fuel injection results in the $\Delta P_1$.

The common rail pressure Pc having fallen owing to the fuel injection is restored by the fuel from the high-pressure fuel pump 8 to a preselected pressure level necessary for providing the fuel injection at any cylinder, in which the next combustion is to be carried out in accordance with the firing order of the engine. Each cycle of pump operation in the high-pressure fuel pump 8 includes a former stroke portion of useless-displacement volume duration Ta, starting from the time $t_0$ at which the plunger is at its BDT, and a residual stroke portion of full-power discharge duration Tpf. The full-power discharge duration Tpf is in corresponding to a duration during which the engine is operated under the maximum load and, therefore, the fuel may be discharged over the entire range capable of fuel discharging. In contrast, now supposing the event the engine operates under a partial load, it is not necessary to discharge the fuel during the overall full-power discharge duration Tpf. To cope with this, the flow-rate control valve 14 at the discharge end of the high-pressure, fuel pump 8 allows the fuel to leak partially to the fuel tank 4 via the fuel-return line 10 for a first preset duration out of the full-power discharge duration Tpf, and to flow into the common rail 2 through the fuel line 9 for a discharge duration Tp, or a last partial duration till the end of the full-power discharge duration Tpf. The fuel is supplied to the common rail 2 via the fuel line 9 during the discharge duration Tp and, therefore, the common rail pressure Pc may recover gradually.

The common rail pressure Pc after the end of the fuel injection is measured at the timing ts, which is after a lapse of a length of time Ts from the time $t_0$. To this end, the timing Ts is selected so as to satisfy the following inequality $$T_0+Td<T_0+Ts<Ta+Tpf-Tp$$

Figure 2:
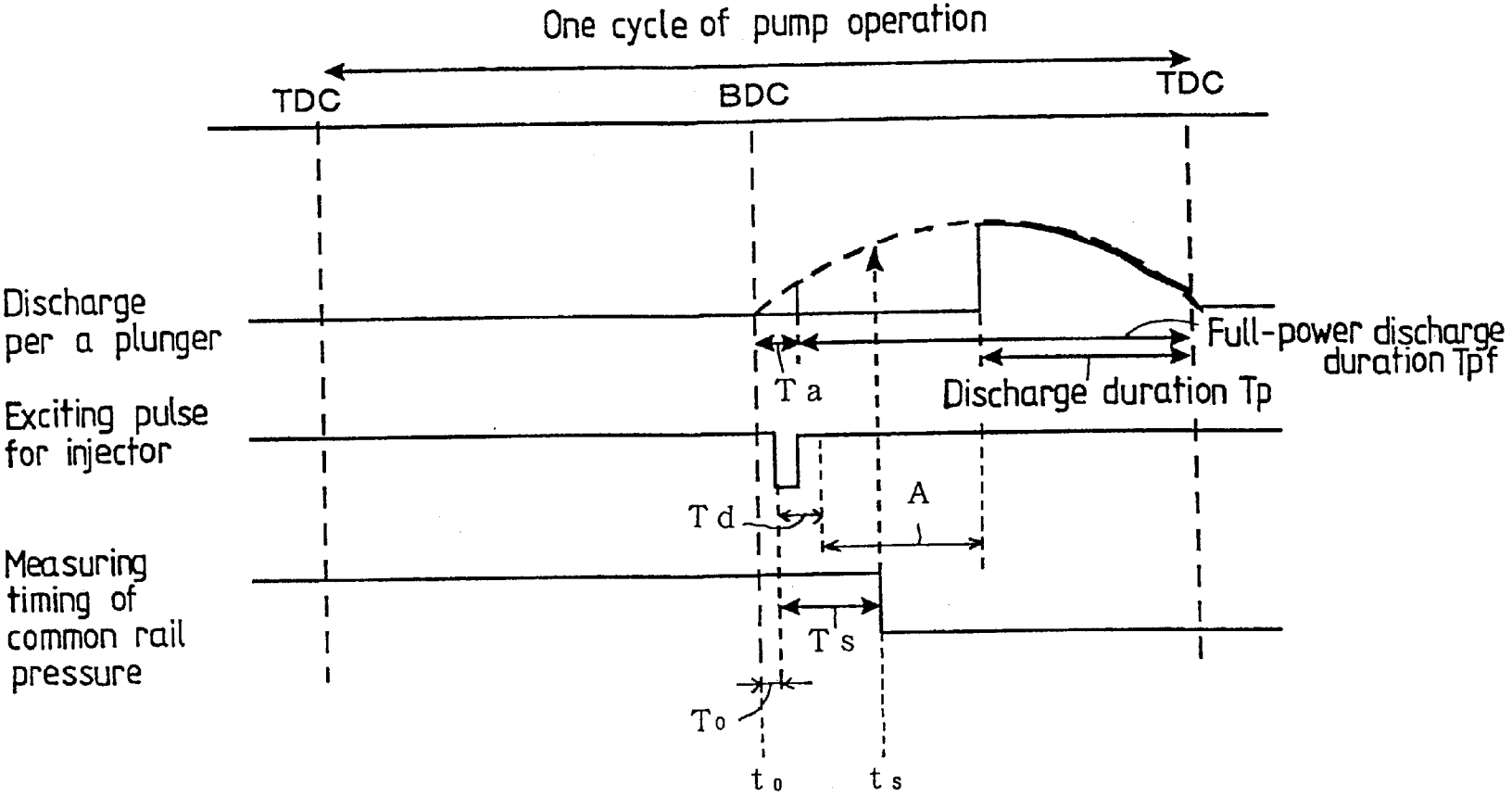
FIG. 2 is a graphic representation illustrating detecting timings as to a discharge of a high-pressure pump, an exciting pulse for the injectors and the common rail pressure, during one cycle of the pump operation.

The timing ts, which is after a lapse of a length of time Ts starting the pulse fall of the exciting signal from the time $t_0$, is defined within a span of time shown in A in FIG. 2, or a span of time from any time after the end of the fuel injection to any other time before the start of the fuel discharge by the plunger for providing the fuel injection at any cylinder, in which the next combustion is to be carried out in accordance with the firing order of the engine. The discharge duration Tp is calculated in accordance with the common rail pressure and the discharge demanded for the quantity of fuel to be injected into the cylinder in which the next combustion is to be carried out. In practice, The discharge duration Tp may be defined by controlling a duration during which the flow-rate control valve 14 at the discharge end of the high pressure fuel pump 8 communicates with the fuel line 9.

Figure 3:
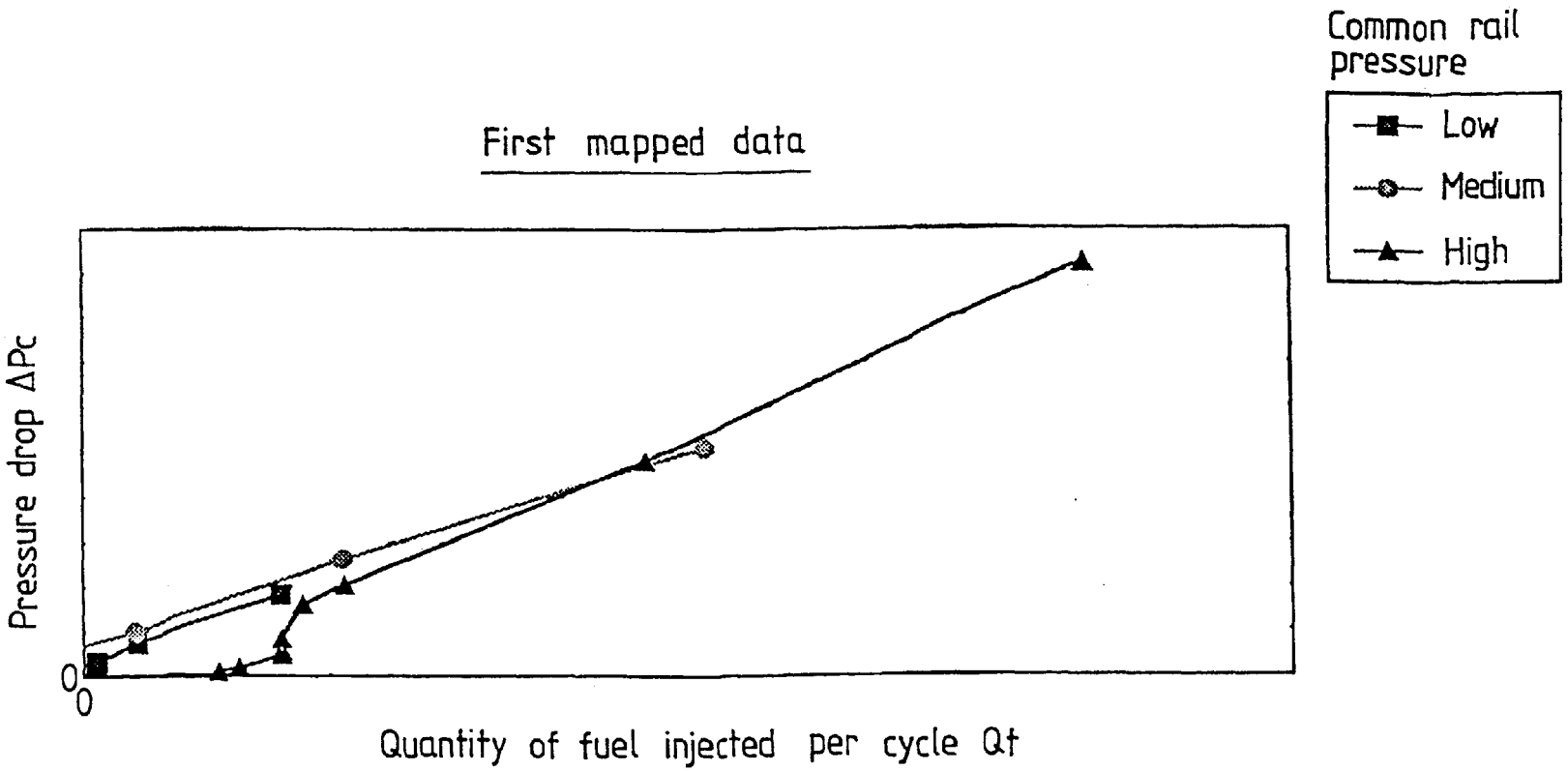
FIG. 3 is a graphic representation showing an exemplary first mapped data used in the common-rail, fuel-injection system of the present invention.

The following is on the assumption that the quantity of static fuel leakage in the injector 1 is the insignificant value. The difference ΔPc between the common rail pressure Pch just before the fuel injection and the common rail pressure Pc1 after the end of the fuel injection is the pressure drop ΔPc owing to a quantity Qt of fuel supplied, which is the sum of the actual quantity Qa of fuel injected and the quantity Q1 of dynamic fuel leakage out of the pressure-control chamber 40. The data as to the pressure drop ΔPc and the quantity Qt of fuel supplied are previously defined in a first mapped data, as shown in FIG. 3, in terms of a parameter taken as the common rail pressure Pc (=Pch) just before the fuel injection. The common rail pressure Pc just before the fuel injection and the pressure drop ΔPc due to the fuel injection are found or calculated, based on the signals reported from the pressure sensor 13 and, therefore, the quantity Qt of fuel supplied may be found from the mapped data in FIG. 3.

Figure 4:
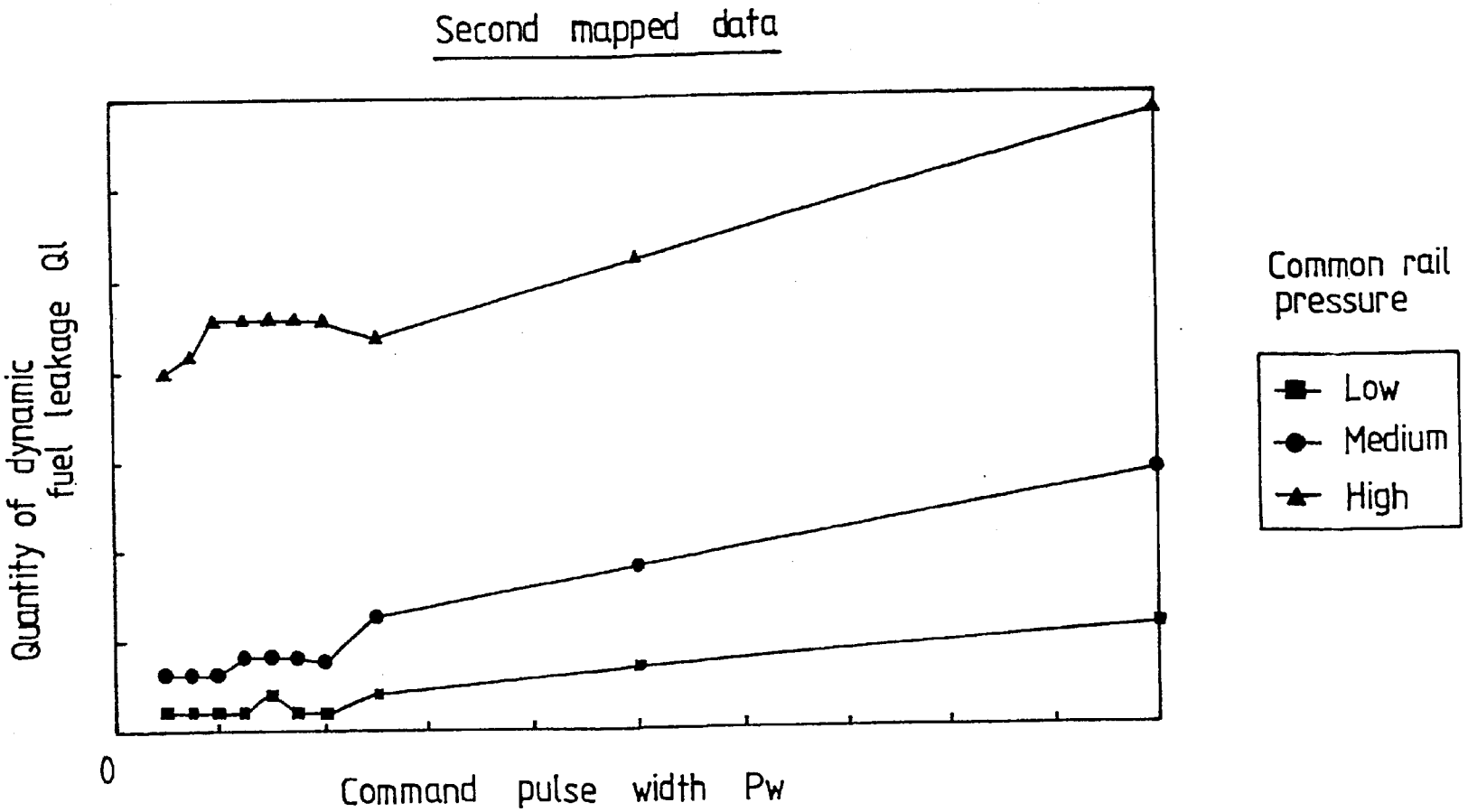
FIG. 4 is a graphic representation showing an exemplary second mapped data used in the common-rail, fuel-injection system of the present invention.

While, in order to find the actual quantity Qa of fuel injected, based on the quantity Qt, the quantity Q1 of dynamic fuel leakage out of the pressure-control chamber 40 is found and then the consequent quantity Q1 of fuel leakage is subtracted from the quantity Qt of fuel supplied. As will be understood the above, the quantity Q1 of dynamic fuel leakage increase as the closure duration of the valve 42 is made greater, which may open and close the fuel path 41 of the pressure-control chamber 40 in accordance with the exciting signal applied to the actuator, or the solenoid-operated valve 15, of the injector 1 and also as the fuel pressure in the pressure-control chamber 40 becomes higher. Defined previously in a second mapped data shown in FIG. 4 is the relationship of the quantity Q1 of dynamic fuel leakage and a pulse width Pw of a command pulse output from the controller unit 12 to determine a duration of the exciting signal applied to the injector 1, in terms of a parameter taken as the common rail pressure Pc just before the fuel injection. The pulse width Pw of the command pulse is a known quantity because it may be found with the controller unit 12 in accordance with the engine operating conditions while the pressure sensor 13 detects the common rail pressure Pc just before the fuel injection and, therefore, the quantity Q1 of dynamic fuel leakage may be obtained by making use of the mapped data. The actual quantity Qa of fuel injected may be given by subtracting the resultant quantity Q1 of dynamic fuel leakage from the quantity Qt of fuel supplied.

Figure 5:
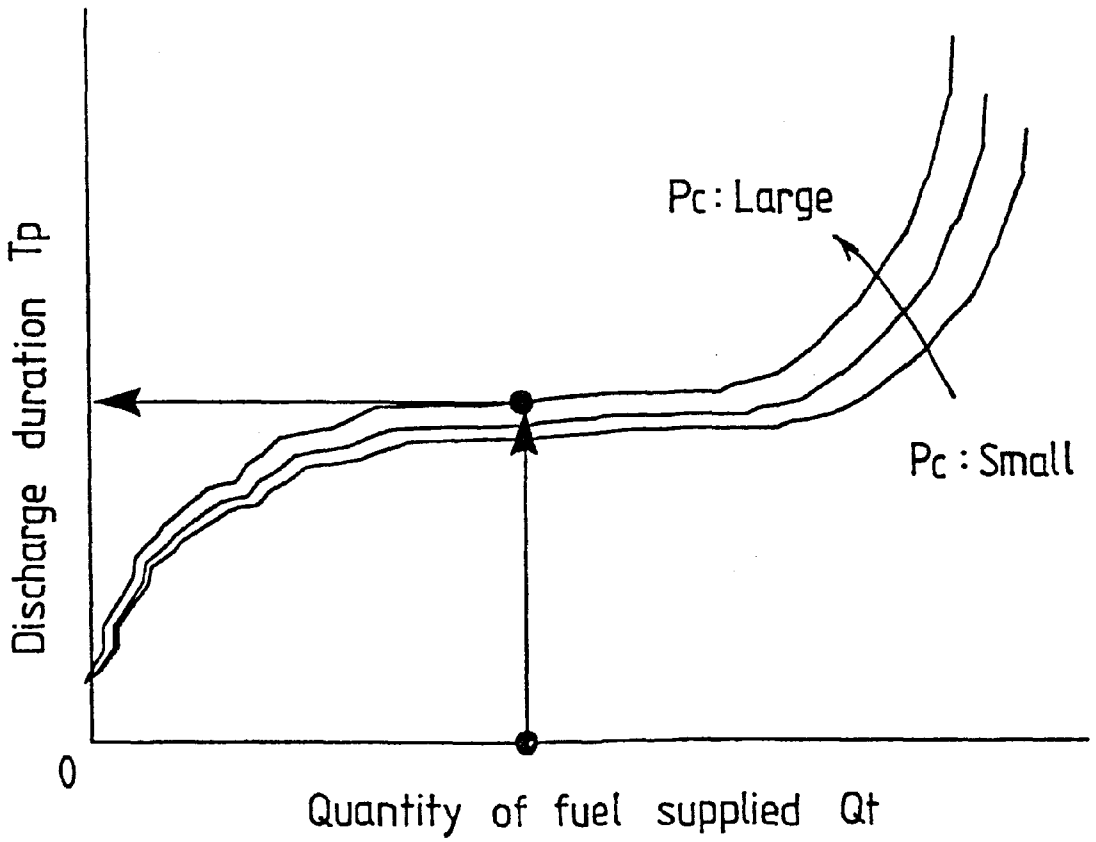
FIG. 5 is a graphic representation of a mapped data showing the relationship of a quantity of the fed fuel and a duration during which the high-pressure fuel pump continues to discharge, in terms of a parameter taken as the common rail pressure just before the fuel injection.

Based on the quantity Qt of fuel supplied, which is the sum of the actual quantity Qa of fuel injected and the quantity Q1 of dynamic fuel leakage, the discharge duration Tp, or the partial-loaded discharge duration, during which the high-pressure fuel pump 8 should continue to discharge the fuel to achieve the quantity Qt of fuel supplied may be obtained from a mapped data in FIG. 5, which has been previously defined in terms of a parameter taken as the common rail pressure just before the fuel injection. The consequent discharge duration Tp is used for determining the timing to detected the reduced common rail pressure Pc immediately after the fuel injection. That is to say, the timing for detecting the common rail pressure Pc reduced due to the fuel injection is defined no later than the time that goes back the discharge duration Tp, starting from the end of the full-power discharge duration Tpf. The timing the fuel injection ceases may be found by monitoring the variation on the common rail pressure. As an alternative, the end of the fuel injection may be recognized as the common rail pressure detected after a lapse of a preset length of time, which is determined dependent on the common rail pressure and the desired quantity of fuel injected, starting from the timing the command pulse has risen or has been turned on. The method of defining the timing the fuel injection ceases is not limited to the concepts as described above, but other suitable methods may be applicable.

In the common-rail, fuel-injection system of the present invention as described above, the actual quantity of fuel injected is found, giving consideration to the quantity of dynamic fuel leakage. Thus, the fuel-injection controlling process in consideration of the quantity of dynamic fuel leakage will be explained below by following the steps in the flowchart shown in FIG. 6. The processing step in FIGS. 6 to 8 will be referred to as a letter "S" hereinafter.

Figure 6:
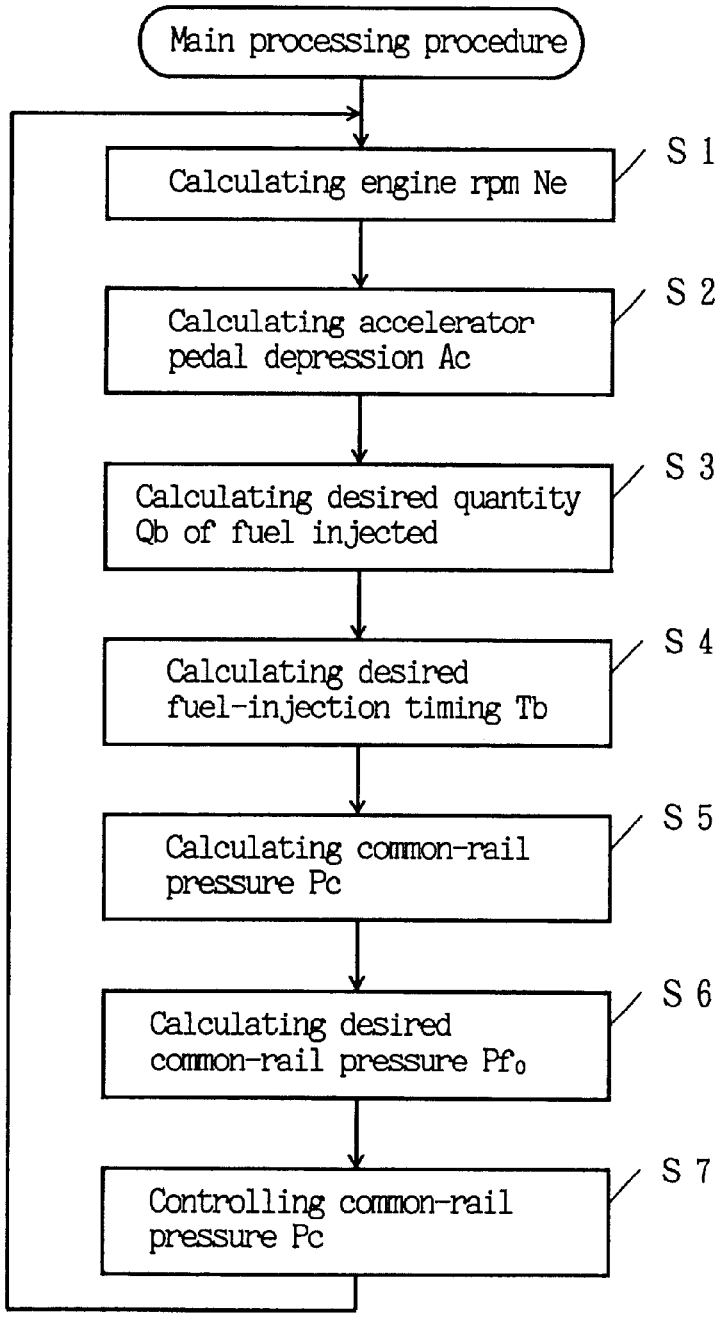
FIG. 6 is a flowchart illustrating a main routine procedure for fuel-injection control in the common-rail, fuel-injection system according to the present invention.
Figure 7:
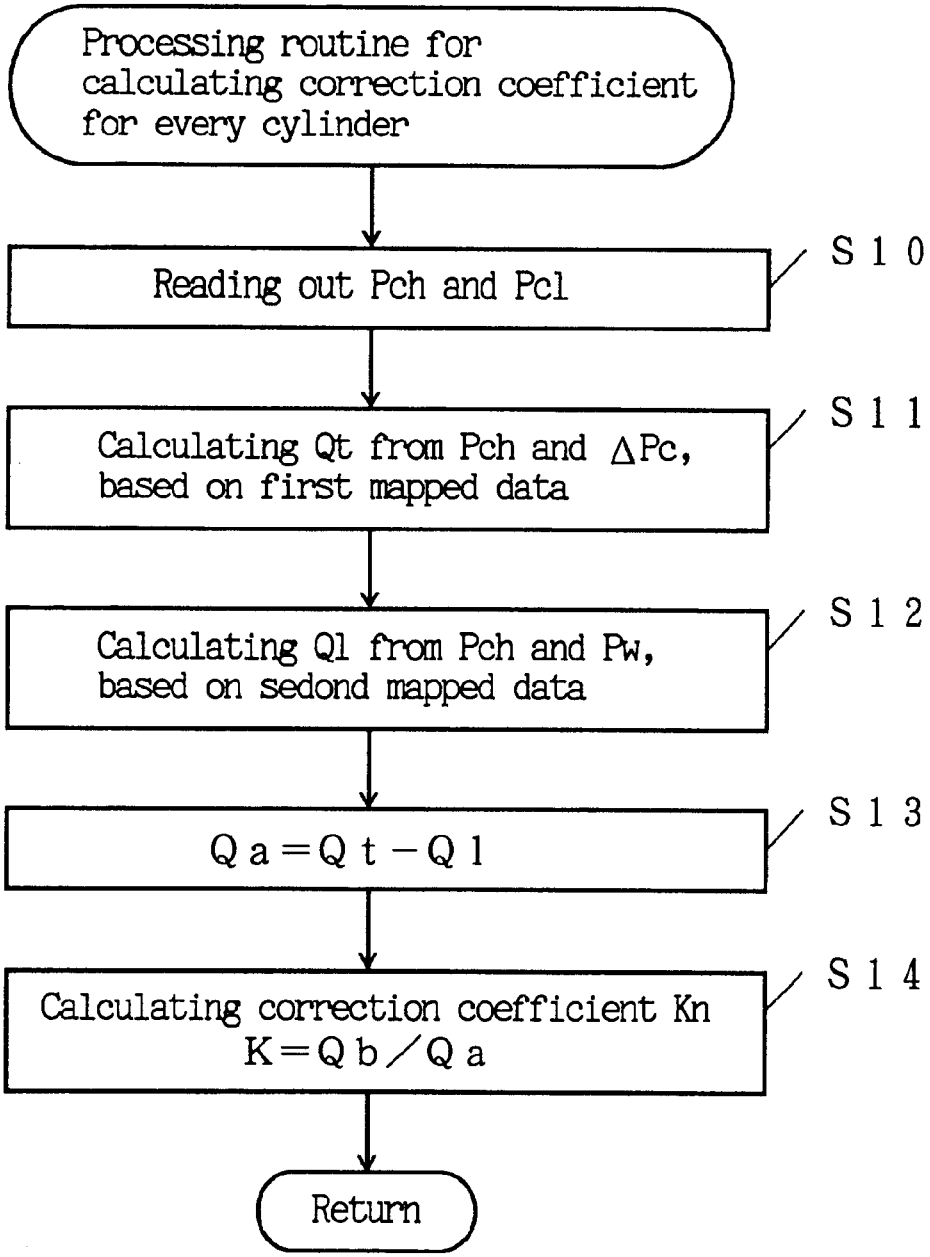
FIG. 7 is a flowchart illustrating a processing routine for calculating a correction coefficient for every cylinder in the common-rail, fuel-injection system of the present invention.

Referring to FIG. 6, an engine rpm Ne out of the engine operating conditions is first reported from a tachometer (S1). An accelerator pedal depression Ac representing an engine load is reported from an accelerator pedal sensor (S2). In accordance with the engine rpm Ne and the accelerator pedal depression Ac obtained at the (S1) and (S2), a desired quantity Qb of fuel injected per cycle and a desired timing Tb of fuel injection are found by referring to a mapped data, not shown, defined previously (S3), (S4). A common rail pressure Pc is calculated based on a detected signal at the pressure sensor 13 (S5). A desired common rail pressure $Pc_0$ is determined for generating the desired quantity that has been found at the (S3). The common rail pressure Pc is controlled so as to be the common rail pressure $Pc_0$ by regulating a ratio of defining the open and the closure of the flow-rate control valve 14 in the high-pressure fuel pump 8, for example, a duty ratio of the solenoid-operated valve (S7).

The common rail pressure Pch just before the fuel injection for every cylinder and the common rail pressure Pc1 after the end of the fuel injection have been obtained by appropriately smoothing the common rail pressure Pc, monitored at the pressure sensor 13 by sampling detection, and stored in a ROM in the controller unit 12. Next referring to FIG. 7, the common rail pressures Pch and Pc1 are red out from the ROM, respectively, for just before and after the fuel injection (S10). By comparing with the mapped data shown in FIG. 3, a quantity Qt of fuel supplied is found, which is conformable to the common rail pressure Pch before the fuel injection and the difference ΔPc (=Pch−Pc1) in pressure (S11). In order to apply an exciting signal for the recent fuel injection to the actuator, or the solenoid-operated valve 15, a quantity Q1 of dynamic fuel leakage correspondent to a pulse width Pw of a command pulse issued from the controller unit 12 is found by comparing with the second mapped data in FIG. 4, in which the relationship of the quantity Q1 versus the pulse width Pw is shown in terms of a parameter taken as the common rail pressure Pch just before the fuel injection (S12). The actual quantity Qa of fuel injected is calculated, based on the quantity Qt of fuel supplied and the quantity Q1 of dynamic leakage fuel found at the (S11) and (S12), respectively, by using the following formula:

$$Qa=Qt-Q1$$

A correction coefficient K is calculated in a ratio of a desired quantity Qb of fuel injected to the actual quantity Qa of fuel injected at the (S3), that is, $$K=Qb/Qa \text{ (S14)}.$$

Figure 8:
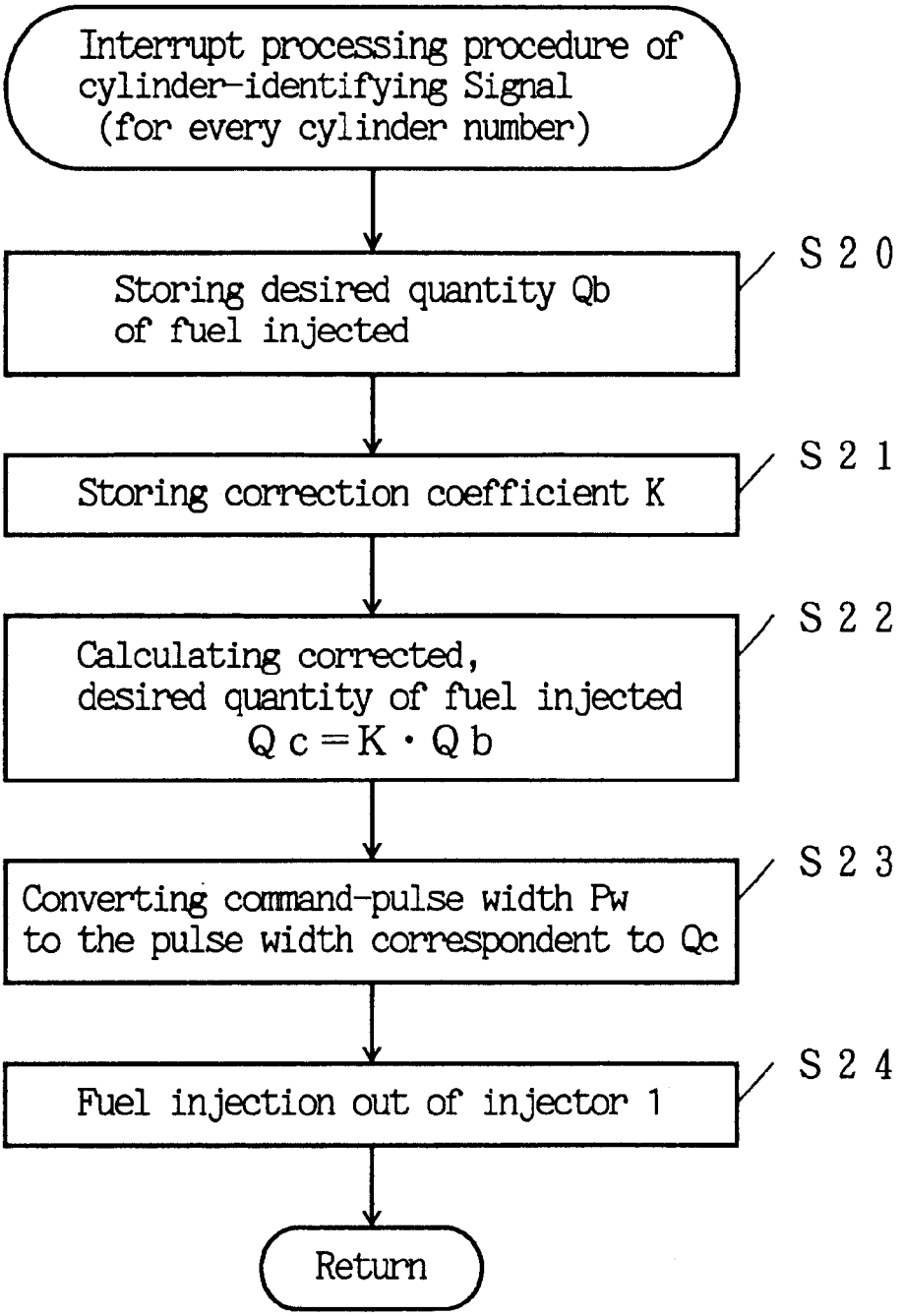
FIG. 8 is a flowchart illustrating an interrupt processing procedure of cylinder-identifying signal in the common-rail, fuel-injection system of the present invention.

Moreover referring to FIG. 8, the desired quantity Qb of fuel injected is stored (S20). The correction coefficient K found at the (S14) is stored (S21). The desired quantity Qb is corrected by using the correction coefficient K to thereby find a corrected, desired quantity Qc of fuel injected, that is, Qc=K×Qb (S22). The corrected, desired quantity Qc of fuel injected usually becomes lager compared with the desired quantity Qb of fuel injected. The command-pulse width Pw is calculated from the mapped data in conformity with the corrected, desired quantity Qc of fuel injected (S23). An exciting signal of the command-pulse width Pw is applied to the solenoid-operated valve 15 of the injector 1 to thereby inject the fuel out of the injector 1 (S.D.). The processing procedure to control the fuel injection as described above is executed for every cylinder 1 to cope with the scattering in characteristics and aging of the individual cylinder.

As this invention may be embodied in several forms without departing from the spirit of essential characteristics thereof, the present embodiment is therefore illustrative and not restrictive, since the scope of the invention is defined by the appended claims rather than by the description proceeding them, and all changes that fall within meets and bounds of the claims, or equivalence of such meets and bounds are therefore intended to embraced by the claims.

What is claimed is:

1. A common-rail, fuel-injection system comprising, a common rail storing therein a fuel discharged out of a high-pressure fuel pump, injectors for spraying the fuel fed from the common rail into combustion chambers, detecting means for monitoring engine operating conditions, and a controller unit for finding a desired quantity of fuel to be injected out of the injectors dependent on signals from the detecting means and controlling fuel injection out of the injectors in accordance with the desired quantity of fuel injected, wherein the controller unit finds a quantity of dynamic fuel leakage out of the injectors upon the fuel injection, and subtracts the quantity of dynamic fuel leakage from the quantity of fuel supplied to the injectors from the common rail to find an actual quantity of fuel injected, whereby the fuel injection out of the injectors is controlled so as to make the desired quantity of fuel injected of the actual quantity of fuel injected.

2. A common-rail, fuel-injection system constructed as defined in claim 1, wherein the detecting means includes a pressure sensor for monitoring a fuel pressure in the common rail, and the controller unit stores therein a first mapped data of a correlation defined previously among the fuel pressure in the common rail just before the fuel injection, an amount of pressure drop taking place in the fuel pressure in the common rail between just before and after the fuel injection and the quantity of fuel supplied, and finds the quantity of fuel supplied upon the fuel injection, based on the first mapped data, in conformity with the fuel pressure in the common rail detected by the pressure sensor at a timing just before the fuel injection and the amount of pressure drop caused by the fuel injection.

3. A common-rail, fuel-injection system constructed as defined in claim 1, wherein the injector includes a pressure-control chamber applied with a part of the fuel fed from the common rail, a needle valve movable upward and downward, depending on a hydraulic action of the fuel in the pressure-control chamber, to thereby open and close fuel-discharge orifices at a distal end of the injector, a valve for allowing the fuel to discharge out of the pressure-control chamber thereby resulting in relieving the fuel pressure in the pressure-control chamber, and an actuator for driving the valve, and wherein the quantity of dynamic fuel leakage is recognized as a quantity of fuel leaking out of the pressure-control chamber past the valve.

4. A common-rail, fuel-injection system constructed as defined in claim 3, wherein the controller unit outputs a command pulse controlling an exciting pulse that is applied to the actuator to open the valve, stores therein a second mapped data of a correlation defined previously among the fuel pressure in the common rail just before the fuel injection, the amount of dynamic fuel leakage and a pulse width of the command pulse, and finds the quantity of dynamic fuel leakage upon the fuel injection, based on the second mapped data, in accordance with the command pulse width that is found dependent on the fuel pressure in the common rail detected by the pressure sensor at the timing just before the fuel injection and the amount of pressure drop caused by the fuel injection.

5. A common-rail, fuel-injection system constructed as defined in claim 1, wherein the engine is of a multi-cylinder engine, the controller unit finds the actual quantity of fuel injected for every cylinder, and controls the fuel injection out of the injector for the individual cylinder, depending on the associated actual quantity of fuel injected.

6. A common-rail, fuel-injection system constructed as defined in claim 5, wherein the controller unit finds a correction coefficient represented by a ratio of the desired quantity of fuel supplied with respect to the actual quantity of fuel injected, finds a corrected, desired quantity of fuel injected by multiplying the correction coefficient by the desired quantity of fuel to be injected at next fuel injection of the same injector whereby the next fuel injection out of the same injector is controlled dependent on the corrected, desired quantity of fuel injected.

7. A common-rail, fuel-injection system constructed as defined in claim 5, wherein the high-pressure fuel pump is of a fuel-supply plunger pump for discharge the fuel to the common rail to spray the fuel out of the injector for the individual cylinder, the controller unit carries out, during each plunger in the high-pressure fuel pump travels from its bottom dead center to its top dead center, the fuel injection out of the injector at the cylinder associated with the plunger and the fuel discharge out of the high-pressure fuel pump into the common rail.

8. A common-rail, fuel-injection system constructed as defined in claim 7 wherein the high-pressure fuel pump is provided at a discharge end thereof with a flow-rate control valve, the controller unit regulates the flow-rate control valve so as to make a timing, at which a full-power discharge duration ceases, coincide with an end of a discharge duration during which the high-pressure fuel pump discharges the fuel for providing the next fuel injection at any cylinder in accordance with the firing order.

9. A common-rail, fuel-injection system constructed as defined in claim 8 wherein the controller unit makes the fuel pressure in the common rail after the delivery of the fuel by the high-pressure fuel pump for the fuel injection while before the start of the exciting signal to the injector for the fuel injection the fuel pressure in the common rail just before the fuel injection, and further makes the fuel pressure in the common rail detected after the end of the fuel injection while before the start of the discharge duration of the fuel by the high-pressure fuel pump for the next fuel injection the fuel pressure in the common rail after the fuel injection.

* * * * *